United States Patent [19]

Hamai

[11] Patent Number: 4,694,797

[45] Date of Patent: Sep. 22, 1987

[54] FUEL SUPPLY SYSTEM FOR INTERNAL COMBUSTION ENGINE

[75] Inventor: Kyugo Hamai, Yokosuka, Japan

[73] Assignee: Nissan Motor Company, Limited, Japan

[21] Appl. No.: 921,769

[22] Filed: Oct. 22, 1986

[30] Foreign Application Priority Data

Oct. 23, 1985 [JP] Japan ..... 60-235427

[51] Int. Cl.[4] ..... F02M 3/07; F02M 3/12

[52] U.S. Cl. ..... 123/339; 123/470; 123/585

[58] Field of Search ..... 123/339, 445, 470, 472, 123/585

[56] References Cited

U.S. PATENT DOCUMENTS 3,943,904 3/1976 Byrne .
4,186,708 2/1980 Bowler .
4,335,689 6/1982 Abe et al. ..... 123/339
4,584,981 4/1986 Tanabe et al. ..... 123/585 X

FOREIGN PATENT DOCUMENTS 3477 1/1985 Japan ..... 123/470
45774 3/1985 Japan ..... 123/470
848724 7/1981 U.S.S.R. ..... 123/339

*Primary Examiner*—Tony M. Argenbright
*Attorney, Agent, or Firm*—Lowe, Price, LeBlanc, Becker & Shur

[57] ABSTRACT

In a single point injection system of the kind having an electronically controlled fuel injector disposed upstream of a throttle valve, a throttle body is formed with a fuel storage chamber and an idle fuel pickup passage for supplying fuel in the fuel storage chamber into an auxiliary air passage in such a manner that a quantity of fuel supplied through the idle fuel pickup passage is proportional to the flow rate of air passing through the auxiliary air passage.

7 Claims, 3 Drawing Figures

FUEL SUPPLY SYSTEM FOR INTERNAL COMBUSTION ENGINE

BACKGROUND OF THE INVENTION

1. Field of the Invention

The present invention relates to a fuel supply system for an internal combustion engine, particularly of the kind having an electronically controlled fuel injector.

2. Description of the Prior Art

As an example of a fuel supply system of the above described kind, there is known a single point injection system which has an electronically controlled single injector at a collector portion of an air induction passage or intake manifold. In a kind of single point injection system, a fuel injector is disposed upstream of a throttle valve with a view to improving the production of air-fuel mixture, as disclosed in U.S. Pat. Nos. 3,943,904 and 4,186,708 issued Mar. 16, 1976 and Feb. 15, 1980 to James C. Byrne and Lauren L. Bowler, respectively.

FIG. 3 shows a single point injection system of the above described kind. In the drawing, designated by the reference numeral 1 is a throttle body, by 2 a fuel injector disposed upstream of a throttle valve 3, by 4 an intake manifold, by 5 an electronic control unit to which signals are supplied from a throttle sensor 6, a coolant temperature sensor 7, an oxygen sensor 10, an air flow meter 11, etc., and by 12 an idle speed control valve.

With this arrangement, the quantity of fuel to be supplied into the engine per working stroke is metered by controlling the opening period of the fuel injector 2. For this purpose control pulses are supplied by the control unit 5, their duration depending on the quantity of intake air or manifold vacuum, engine speed and other correction variables. During idling, with the throttle valve 3 fully closed, the degree of opening of the idle speed control valve 12 is controlled variably depending upon variations in operation of the air conditioner, heater, lights, etc. so as to achieve a desired quantity of auxiliary air supplied through an auxiliary air passage 13.

A disadvantage of the prior art fuel supply system of the above described kind is that since the fuel injector 2 is disposed upstream of the throttle valve 3 and the auxiliary air passage 13, fuel is likely to collect in liquid form on the walls of the throttle body 1 and the auxiliary air passage 12 when an air-fuel mixture flows through the narrow space between the throttle valve 3 and the throttle body 1 and through the auxiliary air passage 13 during idling while at the same time part of fuel is likely to collect in liquid form on the upper face of the throttle valve at the time of fuel injection, thus momentarily reducing the quantity of fuel to be supplied into the engine per working stroke and therefore permitting the air-fuel mixture to become leaner than desired momentarily to result in a delay in idle speed control and therefore unstable idling.

SUMMARY OF THE INVENTION

In accordance with the present invention, there is provided a novel and improved fuel supply system which comprises a throttle body having a throttle bore, a throttle valve disposed in the throttle bore, a fuel injector disposed upstream of the throttle valve for injection of fuel into the throttle bore, auxiliary air passage means formed in throttle body for providing communication between portions of the throttle bore upstream and downstream of the throttle valve, and an idle speed control valve disposed in the auxiliary air passage means for controlling the flow rate of auxiliary air passing therethrough and thereby achieving a predetermined idle speed.

The above structure may follow the conventional fashion. In accordance with this invention, the fuel supply system further comprises fuel storage chamber means formed in the throttle body for storing therewithin a predetermined quantity of fuel, and idle fuel pickup passage means having an end projecting into the fuel within the fuel storage chamber means and the other end communicated with the auxiliary air passage means for drawing fuel thereinto from the fuel storage chamber means and supplying it into the auxiliary air passage means.

The foregoing structure is quite effective for overcoming the above noted disadvantages and shortcomings inherent in the prior art system.

It is accordingly an object of the present invention to provide a novel and improved fuel supply system for an internal combustion engine which, during idling, can vary the air-fuel ratio with an improved responsiveness in response to variations on the load on the engine thereby reducing variation of idle speed and therefore can improve the idling stability.

DETAILED DESCRIPTION OF THE PREFERRED EMBODIMENT

Figure 1:
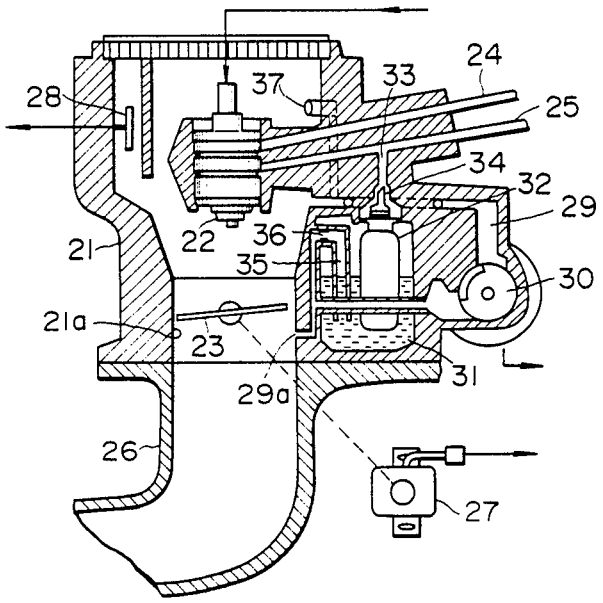
FIG. 1 is a schematic view of a fuel supply system for an internal combustion engine according to the present invention.

Referring to FIG. 1, a fuel supply system of this invention is shown as including a throttle body 21 having a throttle bore **21*a*, a fuel injector 22 disposed upstream of a throttle valve 23, a fuel supply conduit 24 and a fuel return conduit 25 connected to the fuel injector 23, an intake manifold 26 communicated at its collector portion with the throttle bore 21*a*, a throttle sensor 27 and an air flow meter 28** of the hot-wire type. The above structure is substantially similar to the prior art.

An auxiliary air passage 29 is formed in the throttle body 21 to bypass the throttle valve 23, i.e., the auxiliary air passage 29 is so formed as to provide communication between the portions of the throttle bore **21*a* upstream and downstream of the throttle valve 23. The auxiliary air passage 29 has disposed therein an idle speed control valve 30, similarly to the prior art and is disposed so that its downstream end 29*a* opens to or communicates with a portion of the throttle bore 21*a* immediately downstream of the throttle valve 23** in its fully closed position to constitute a slow port or an idle discharge port.

The throttle body 21 is formed with a fuel storage chamber 31 for storing therein fuel and has disposed therein a float 32. A needle valve 34 is attached to the upper end face of the float 32 to move together therewith and is associated at its upper end with a communication passage 33 providing communication between the fuel return conduit 25 and the fuel storage chamber 31 in such a manner that the needle valve 34 closes the communication port 33 to stop supply of fuel from the fuel return conduit 25 to the fuel storage chamber 31 when the quantity of fuel within the fuel storage chamber 31 exceeds a predetermined value.

An idle fuel pickup passage 35 having disposed therein a slow jet 36 in the form of an orifice is provided to the throttle body 21 and adapted to have an end projecting into the fuel within the fuel storage chamber 31 and the other end communicating the auxiliary air passage 29. An atmospheric pressure passage 37 is formed in the throttle body 21 for supplying the atmospheric pressure to the fuel storage chamber 31.

The fuel supply system of this invention operates as follows:

During idling, the degree of opening of the idle speed control valve 30 is controlled variably depending upon variations in operation of the engine so as to adjust the flow rate of air passing through the auxiliary air passage 29 to a desired value and to thereby attain stable idling, as similarly to the prior art. In this instance, according to the present invention, a quantity of fuel proportional to the flow rate of air passing through the auxiliary air passage 29 is metered by the slow jet 36 and drawn from the fuel storage chamber 31 through the idle fuel pickup passage 35 into the auxiliary air passage 29 to produce an air-fuel mixture. The air-fuel mixture thus produced is drawn from the idle discharge port 29*a* at the downstream end of the auxiliary air passage 29 into the intake manifold 26 and then supplied into the cylinders of the engine.

In this manner, an air-fuel mixture can be produced depending upon the flow rate of auxiliary air per se passing through the auxiliary air passage 29, whereby a desired air-fuel mixture can be supplied into the engine at the instant of necessity thereby making it possible to control the idle speed based upon engine load with an improved responsiveness.

Figure 2:
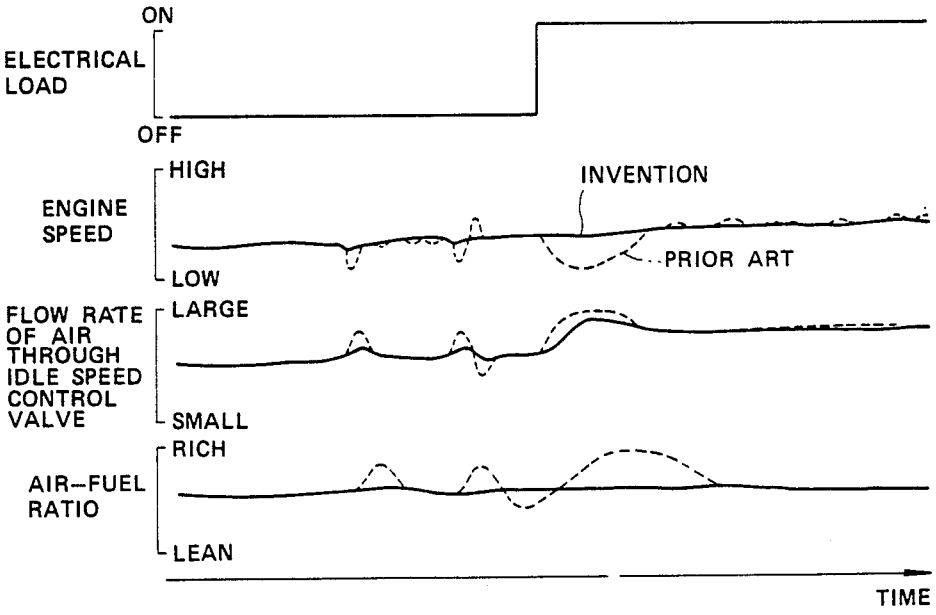
FIG. 2 is a graph showing the performance characteristics of the fuel supply system of FIG. 1 in comparison with a comparable prior art system.
Figure 3:
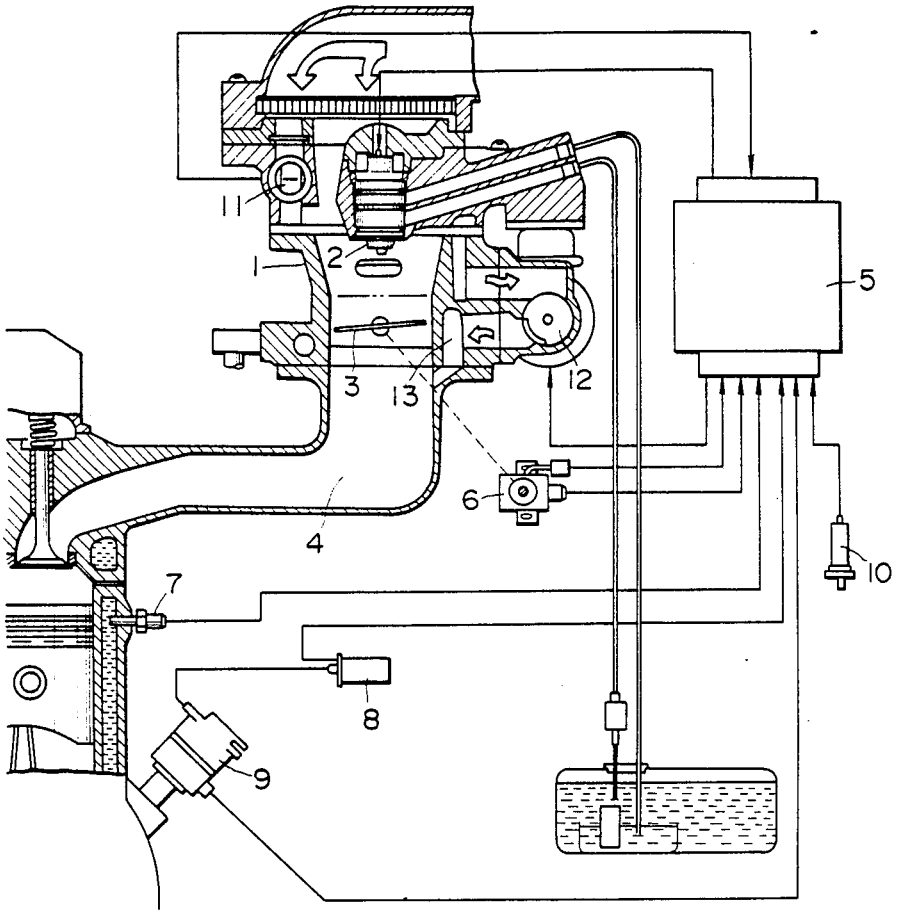
FIG. 3 (PRIOR ART)
FIG. 3 is a schematic view of a prior art fuel supply system for an internal combustion engine.

FIG. 2 shows the performance characteristics of this invention in comparison with a comparable prior art system, wherein the present invention is indicated by the solid line while the prior art by the dotted line. From this graph, it will be understood that the fuel supply system of this invention can effect more stable idling than the prior art.

In the foregoing, as to the injection of fuel from the fuel injector 22 at idling, it may be stopped completely in response to the signals supplied to the idle speed control valve 30 or a basic quantity of fuel may be kept injected so as to be supplied into the engine together with the fuel supplied from the auxiliary air passage 29 wherein, however, the basic quantity of fuel is controlled variably so as to achieve the desired air-fuel mixture such as the stoichiometric air-fuel ratio through a feed back control using an oxygen sensor, etc., for instance.

What is claimed is:

1. A fuel supply system for an internal combustion engine, comprising:

a throttle body having a throttle bore;

a throttle valve disposed in said throttle bore;

a fuel injector disposed upstream of said throttle valve for injection of fuel into said throttle bore;

auxiliary air passage means formed in said throttle body for providing communication between portions of said throttle bore upstream and downstream of said throttle valve;

an idle speed control valve disposed in said auxiliary air passage means for controlling the flow rate of auxiliary air passing therethrough and thereby achieving a predetermined idle speed;

fuel storage chamber means formed in said throttle body for storing therewithin a predetermined quantity of fuel; and idle fuel pickup passage means having an end projecting into the fuel within said fuel storage chamber means and the other end communicated with said auxiliary air passage means for drawing fuel thereinto from said fuel storage chamber means and supplying it into said auxiliary air passage means.

2. A fuel supply system as set forth in claim 1, further comprising an intake manifold having a collector portion, said throttle body having an end corresponding to a downstream end of said throttle bore and attached thereat to said collector portion.

3. A fuel supply system as set forth in claim 2 wherein said auxiliary air passage means has a downstream end opening to a portion of said throttle bore immediately downstream of said throttle valve in its fully closed position and adapted to constitute an idle fuel discharge port.

4. A fuel supply system as set forth in claim 3 wherein said idle fuel pickup passage means is provided with a slow jet in the form of an orifice.

5. A fuel supply system as set forth in claim 4, further comprising fuel supply passage means for supply of fuel to said fuel injector, fuel return passage means for return of fuel from said fuel injector and communication passage means for providing communication between said fuel return passage means and said fuel storage chamber means.

6. A fuel supply system as set forth in claim 5, further comprising atmospheric pressure passage means formed in said throttle body for supply atmospheric pressure to said fuel storage chamber means.

7. A fuel supply system as set forth in claim 6, further comprising a float disposed in said fuel storage chamber means and a needle valve movable together with said float and capable of closing said communication passage means when the quantity of fuel in said fuel storage chamber means exceeds a predetermined value.

* * * * *